United States Patent [19]

Asayama

[11] 3,975,917

[45] Aug. 24, 1976

[54] FLANGED FOUNDATION PILE GROUP AND METHOD OF CONSTRUCTING A FOUNDATION BY MEANS OF THE SAME

[76] Inventor: Kingo Asayama, 9-1, 3-chome, Kourigaoka, Hirakata, Osaka, Japan

[22] Filed: Aug. 22, 1974

[21] Appl. No.: 499,784

[52] U.S. Cl. ..... 61/53; 61/35; 61/50

[51] Int. Cl.[2] ..... E02D 5/30

[58] Field of Search ..... 61/35, 53.6, 53, 53.5, 61/53.68, 56, 36 R, 50

[56] References Cited

UNITED STATES PATENTS

| | | | |
|---|---|---|---|
| 1,443,306 | 1/1923 | Blumenthal | 61/53.6 |
| 1,501,643 | 7/1924 | Blumenthal et al. | 61/53.6 |
| 2,627,169 | 2/1953 | Poulter | 61/35 |
| 3,913,337 | 10/1975 | Merjan | 61/50 |

FOREIGN PATENTS OR APPLICATIONS

| | | | |
|---|---|---|---|
| 280,293 | 12/1930 | Italy | 61/56 |
| 302,101 | 12/1928 | United Kingdom | 61/50 |

*Primary Examiner*—Paul R. Gilliam
*Assistant Examiner*—David H. Corbin
*Attorney, Agent, or Firm*—Price, Heneveld, Huizenga & Cooper

[57] ABSTRACT

A group of piles herein described consists of a plurality of flanged foundation piles, each of which has a plurality of flanges integrally formed around a pole body at a predetermined interval, and which comprise means for making the vertical positions of the respective flanges on mutually adjacent foundation piles vertically staggered with each other when said foundation piles have been driven into the earth, whereby the earth intervening between said adjacent foundation piles may have uniform compactness.

2 Claims, 5 Drawing Figures

Figure 1:
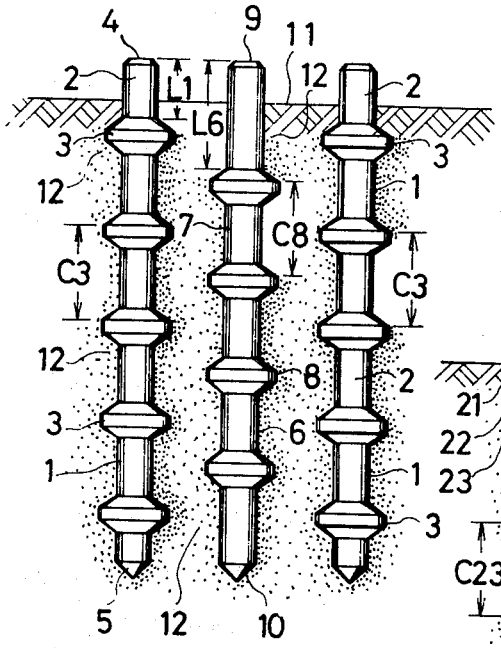

FLANGED FOUNDATION PILE GROUP AND METHOD OF CONSTRUCTING A FOUNDATION BY MEANS OF THE SAME

The present invention relates to improvements in foundation piles to be used for reinforcing the foundation earth of a building, and to an improved method for constructing a foundation.

More particularly, the present invention relates to an improved method for constructing a foundation, in which flanged piles each having a number of flanges provided thereon at appropriate intervals formed by shank portions are vertically driven into the earth at appropriate lateral intervals, a filler such as sand, gravel, etc. being replenished under said flanges while said flanged pile is being driven, and said flanged piles are driven so that in their final positions in the earth the flanges on the respective piles may be positioned in a vertically staggered relationship to each other, whereby a substantially uniform zone of compactly pressed sand, gravel, etc. may be established between said flanged piles over the entire region surrounding said piles from top to bottom; and also relates to a group of foundation piles to be used in said improved method.

Heretofore, it has been a common practice to drive a great number of cylindrical piles into a given region of the earth at appropriate lateral intervals for establishing a foundation earth, and thereby an expected effect has been achieved to a certain extent. However, in order to realize an increased strong frictional effect, the use of the so-called flanged piles or friction piles which are provided with a number of flange portions on the cylindrical pile surfaces, has been more effective.

Although the degree of disturbance in uniformity of the soil organization in the peripheral portions of the piles upon driving such flanged piles into the earth is extremely large in contrast to the case of the former cylindrical piles, by replenishing a filler such as sand, gravel, etc. into the vacant portion in the earth formed by the flange portion upon driving the flanged piles the soil between the respective flanged piles can be strongly compacted, so that the filler of sand, gravel, etc. may be integrated with the pile bodies in the earth, and therefore, an advantage can be obtained that a foundation layer similar to a strong foundation layer formed with piles having a larger diameter is established.

However, upon driving said flanged piles, while the filler of sand, gravel, etc. is, indeed, reliably filled in the earth in the proximity of the ground surface, it is seldom that the filler is positively and reliably filled in the earth at the lower portion of the pile, for example, at the deepest portion in the earth, depending upon the condition of the earth foundation into which the pile is to be driven, and consequently, vacant spaces caused by the insertion of said flanges are left at the lower portions of the respective piles. Therefore, naturally an adverse effect is brought about upon the supporting force of the pile. Especially, in case of driving a group of flanged piles into the earth, said filler or the soil between the piles is strongly pressed and compacted in the space between the opposed flanges of the adjacent piles, and further this is moved upwardly to be organized in an arcuated form, so that not only the condition of compactness of the earth between the flanges of the adjacent piles is made unstable, but also the condition of compactness of the earth between the flangeless portions of the adjacent piles is also made irregular, and thus it is quite doubtful whether or not a reliable and strong foundation can be really established in the earth as an effect of a pile group consisting of a great number of piles.

It is an object of the present invention to provide a novel method of constructing a foundation, in which the aforementioned disadvantages are completely eliminated and yet the advantage essential to the flanged pile is fully attained, and in which a strongly pressed compact earth zone that is far larger and more uniformly tamped than the improved foundation earth constructed according to the conventional method of construction can be established.

Another object of the present invention is to provide a novel foundation pile group that is to be used in said novel method of constructing a foundation.

Generally describing the method according to the present invention which is most adapted to achieve the aforementioned objects, a plurality of piles, each of which is provided with an appropriate number of flanges having a larger diameter than the diameter of the pile body in accordance with the entire length of the pile at a predetermined interval on the circumferential surface portion, are vertically driven at predetermined positions having a measured interval therebetween, then said piles are gradually sunk into the earth while striking the heads of said piles with a hammer such as a drop hammer, a Diesel hammer, a vibro hammer and the like, and simultaneously therewith the flanges having a larger diameter than the diameter of said pile body also cut away the soil around the pile as said pile is lowered, and produce vacant spaces around the pile body, a filler of sand, gravel, etc. being continuously replenished into these vacant spaces, so that said filler follows the lowering motion of said pile owing to the press-down force exerted by the lower pushing surface of the upper flange, the frictional force produced by the movement of the pile and the impact and/or vibration applied to said pile, and consequently, the same result can be obtained as in the case of driving cylindrical foundation piles having a larger diameter that is substantially equal to the diameter of the flange into the earth.

Subsequently, at a position adjacent to said driven and established pile a predetermined distance apart from the latter, another pile having a circumferential surface portion of the same configuration as said established pile and flanges having a larger diameter than that of the pile body is driven into the earth, while filling a filler of sand, gravel, etc. similarly to the driving of said established pile. Then, by driving the piles up to the condition where the respective flanges of said piles are positioned at the middle points between the vertically adjacent flanges on said adjacent established pile, a staggered relationship between the respective flanges provided on the circumferential surfaces of the adjacent piles is established, so that the filler filled into the spaces around said piles and the soil between the adjacent piles are rigidly and compactly tamped together, and thereby a strong, rigid, compactly pressed zone of foundation can be reliably established, not only in the shallow portion but over a wider region.

Figure 2:
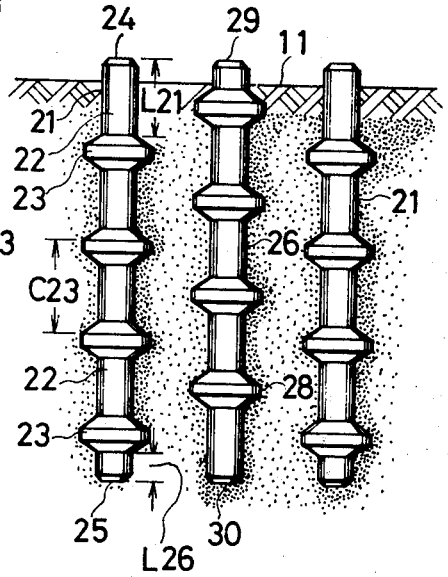
Figure 3:
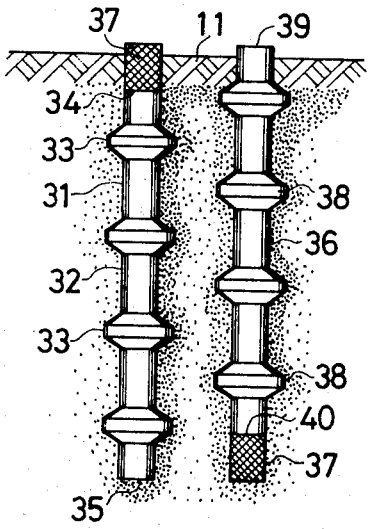
Figure 4:
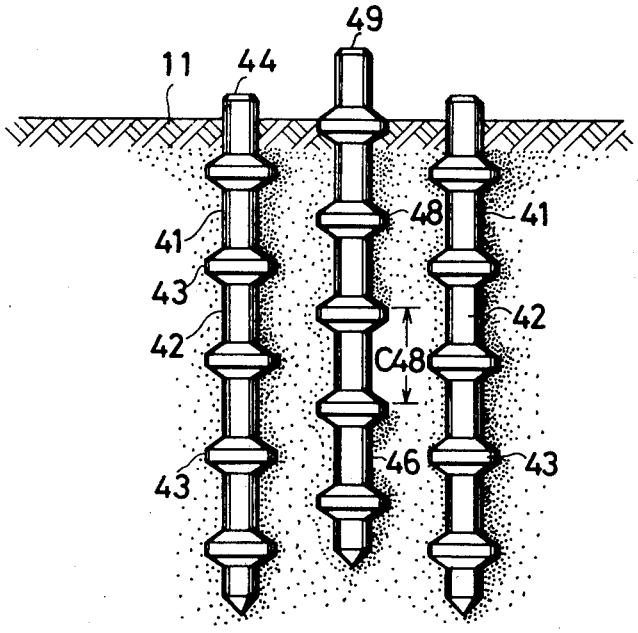
Figure 5:
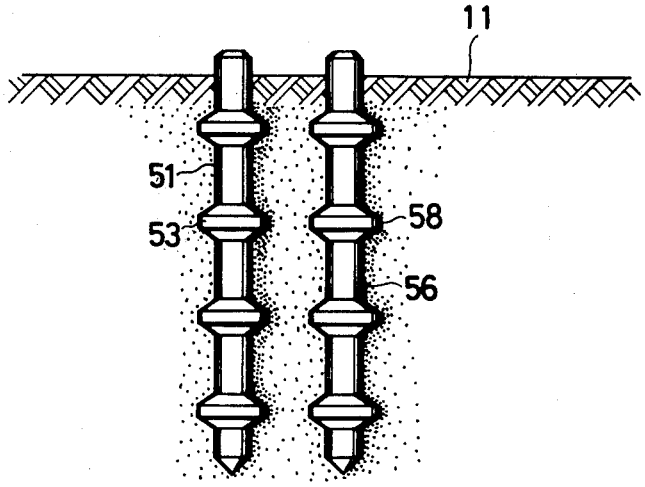

More detailed features of the present invention will be more clearly understood by reference to the following description in connection to the accompanying drawings, in which:

FIG. 1 is a longitudinal cross-section view showing a state of a foundation pile group as driven into the earth according to a first embodiment of the present invention, FIG. 2 is a longitudinal cross-section view showing a similar state of a foundation pile group according to a second embodiment of the present invention, FIG. 3 is a longitudinal cross-section view showing a similar state of a foundation pile group according to a third embodiment of the present invention, FIG. 4 is a longitudinal cross-section view showing a similar state of a foundation pile group according to a fourth embodiment of the present invention, and FIG. 5 is a longitudinal cross-section view showing a state of a foundation pile group in the prior art as driven into the earth.

In FIG. 1, a pile 1 has a plurality of flanges 3 formed on the circumference of a pole 2 integrally therewith, the top end 4 of the pole 2 being flattened, while the bottom end 5 thereof being sharpened, and the intervals C3 between the respective flanges 3 are chosen equal to each other.

Another pile 6 has a plurality of flanges 5 formed on the circumference of a pole 7 integrally therewith, the top end 9 of the pole 7 being flattened, while the bottom end 10 thereof being sharpened, and the intervals C8 between the respective flanges 8 are chosen equal to each other and equal to the interval C3 between the flanges 3.

Reference numeral 11 designates the earth, into which the foundation pile 1 is driven while sand or gravel 12 is being replenished, and adjacent to said foundation pile 1 the foundation pile 6 is driven into the earth while sand or gravel 12 is being replenished similarly to the foundation pile 1. In this case, since the distance L6 between the top end 9 of the pole 7 of the foundation pile 6 and the uppermost flange 8 of the same is designed longer than the distance L1 between the top end 4 of the pole 2 of the foundation pile 1 and the uppermost flange 3 of the same, under the state where these foundation piles have been driven into the earth and the top end 4 of the pile 1 and the top end 9 of the pile 6 are aligned on the same level, the positions of the respective flanges 3 of the pile 1 and the positions of the respective flanges 8 of the pile 6 are vertically staggered with each other as shown in FIG. 1.

In FIG. 2, a pile 21 has a plurality of flanges 23 formed on the circumference of a pole 22 integrally therewith, both the top end 24 and the bottom end 25 of the pole 22 being flattened, and the intervals C23 between the respective flanges 23 are chosen equal to each other.

It is to be noted that the distance L21 between the top end 24 and the uppermost flange 23 is designed equal to the distance L26 between the bottom end 25 and the lowermost flange 23.

Another pile 26 has exactly the same configuration and the same dimension as the above-described pile 21, but it has been driven upside-down into the ground. If the latter pile 26 has been driven until its top end 29 comes to the same level as the top end 24 of the already driven former pile 21, then the positions of the respective flanges 23 of the pile 21 and the positions of the respective flanges 28 of the pile 26 are staggered with each other.

In FIG. 3, a pile 31 has a plurality of flanges 33 formed on the circumference of a pole 32 integrally therewith, both the top end 34 and the bottom end 35 of the pole 32 being flattened, and to said top end 34 is fixedly secured a pile shoe 37. In this case also, the intervals between the adjacent flanges are chosen equal to each other.

Another pile 36 has exactly the same configuration and the same dimension as the above-described pile 31, but it has been driven upside-down into the ground adjacent to said pile 31. If the top end 39 of the pile 36 and the top end of the pile shoe 37 attached to the top of the pile 31 are aligned on the same level, then the positions of the flanges 33 of the pile 31 and the positions of the flanges 38 of the pile 36 are staggered with each other. It is to be noted that a pile shoe 37 could be fixedly secured to the bottom end 40 of the pile 36.

In FIG. 4, a pile 41 has a plurality of flanges 43 formed on the circumference of a pole 42 integrally therewith, and another pile 46 to be driven into the earth adjacent to said pile 41 is exactly the same as said pile 41. Upon driving these piles into the earth, in the final state the level of the top end 49 of the pile 46 is positioned higher than the level of the top end 44 of the pile 41 by an amount of about one-half of the interval C48 between the flanges 48. Then the positions of the flanges 43 of the pile 41 and the positions of the flanges 48 of the pile 46 are staggered with each other.

FIG. 5 shows a state of foundation piles established in the earth according to the prior art. In this figure, piles 51 and 56 are exactly the same, and when these piles have been established in the earth the positions of the flanges 53 of the pile 51 and the positions of the flanges 58 of the pile 56 are on the same levels, and consequently, a uniform compactness cannot be attained in the foundation earth portion intervening between two adjacent piles 51 and 56, as described previously.

Since many changes could be made in the above construction and many apparently widely different embodiments of this invention could be made without departing the scope thereof, it is intended that all matter contained in the above description or shown in the accompanying drawings shall be interpreted as illustrative and not in a limiting sense.

What is claimed is:

1. A foundation comprising a first plurality of driven columnar piles having a plurality of equally spaced circumferential flanges of greater diameter than and encircling said piles, said flanges being separated by columnar shank portions; a second plurality of driven columnar piles also having a plurality of equally spaced circumferential flanges of greater diameter than and encircling said piles, said flanges also being separated by columnar shank portions; said flanges of said first and second piles being embedded in the earth; said flanges of said first piles being vertically staggered with respect to and intermediate the flanges of said second plurality of piles with each of the flanges of said first piles being in the same horizontal plane as a shank portion of said second piles, the spacing of said piles being such that the soil intermediate the piles is generally uniformly compacted by the piles.

2. A method of constructing an improved pile foundation including the steps of driving into the earth a plurality of piles each having radially enlarged, encircling flange portions at equally spaced intervals along its length separated by intermediate shank portions; arranging alternate ones of said piles with their flanges staggered with respect to and in the same horizontal plane as a shank portion of the remaining piles and by means of the flanges and their arrangement with respect to alternate piles substantially uniformly compacting the earth surrounding each of said piles and between adjacent pairs of piles to create a zone of improved earth support.

* * * * *